US008866010B2

(12) United States Patent
Nonen et al.

(10) Patent No.: US 8,866,010 B2
(45) Date of Patent: Oct. 21, 2014

(54) DIFFERENTIAL SIGNAL TRANSMISSION CABLE AND MULTI-CORE CABLE

(71) Applicant: Hitachi Cable, Ltd., Tokyo (JP)

(72) Inventors: Hideki Nonen, Mito (JP); Takahiro Sugiyama, Hitachi (JP)

(73) Assignee: Hitachi Metals Ltd., Tokyo (JP)

( * ) Notice: Subject to any disclaimer, the term of this patent is extended or adjusted under 35 U.S.C. 154(b) by 28 days.

(21) Appl. No.: 13/773,537

(22) Filed: Feb. 21, 2013

(65) Prior Publication Data

US 2014/0048302 A1 Feb. 20, 2014

(30) Foreign Application Priority Data

Aug. 17, 2012 (JP) ..... 2012-180897

(51) Int. Cl.
*H01B 11/02* (2006.01)
*H01B 11/06* (2006.01)

(52) U.S. Cl.
CPC ..... *H01B 11/02* (2013.01)
USPC ..... 174/34; 172/36; 172/106; 172/254

(58) Field of Classification Search
USPC ..... 174/34, 36, 110, 107, 110 R, 110 SR, 174/113 R, 117 R, 117 F, 117 FF
See application file for complete search history.

(56) References Cited

U.S. PATENT DOCUMENTS 1,883,269 A * 10/1932 Yonkers ..... 174/27
2,098,149 A * 11/1937 Jewell et al. ..... 174/121 R
2,187,401 A * 1/1940 Potter ..... 174/121 A
2,216,435 A * 10/1940 Eckel ..... 174/102 D
2,662,931 A * 12/1953 Mougey ..... 174/106 R
2,881,243 A * 4/1959 Ebel et al. ..... 174/107
3,785,048 A * 1/1974 Petersen ..... 29/828
4,157,452 A * 6/1979 Pignataro et al. ..... 174/36
4,179,320 A * 12/1979 Midgley et al. ..... 156/86
4,436,565 A * 3/1984 Weitzel et al. ..... 156/49
4,532,375 A * 7/1985 Weitzel et al. ..... 174/107
4,918,260 A * 4/1990 Griffith et al. ..... 174/256
5,015,800 A * 5/1991 Vaupotic et al. ..... 174/34
5,072,073 A * 12/1991 Becker et al. ..... 174/76
5,821,467 A * 10/1998 O'Brien et al. ..... 174/117 F
6,677,518 B2 1/2004 Hirakawa et al.
7,132,028 B1 * 11/2006 Wahlers-Schmidlin et al. ..... 156/184
7,226,969 B2 * 6/2007 Ristic-Lehmann et al. .. 524/544
7,737,358 B2 * 6/2010 Hopkinson et al. ..... 174/27
7,790,981 B2 9/2010 Vaupotic et al.
2003/0098174 A1 * 5/2003 Smith ..... 174/93
2006/0054334 A1 * 3/2006 Vaupotic et al. ..... 174/36
2008/0251277 A1 * 10/2008 Hopkinson et al. ..... 174/116
2010/0038112 A1 * 2/2010 Grether ..... 174/128.1
2011/0083877 A1 * 4/2011 Sugiyama et al. ..... 174/115
2012/0048591 A1 * 3/2012 Gareis ..... 174/102 R
2012/0152589 A1 * 6/2012 Kumakura et al. ..... 174/109
2012/0186850 A1 * 7/2012 Sugiyama et al. ..... 174/102 R
2012/0193122 A1 * 8/2012 Sugiyama et al. ..... 174/113 R

* cited by examiner

*Primary Examiner* — Jenny L Wagner
*Assistant Examiner* — Michael E Moats, Jr.
(74) *Attorney, Agent, or Firm* — McGinn IP Law Group, PLLC

(57) ABSTRACT

A differential signal transmission cable includes a pair of center conductors for transmitting a differential signal, an insulator covering peripheries of the center conductors, a shield tape longitudinally wrapped around the insulator, an insulating tape including an adhesive surface and spirally wrapped around the shield tape while the adhesive surface faces inside, and a non-adhesive tape provided between the shield tape and the insulating tape along a longitudinal direction, and non-adhesively covering a part of an outer periphery of the shield tape in a circumferential direction.

18 Claims, 3 Drawing Sheets

DIFFERENTIAL SIGNAL TRANSMISSION CABLE AND MULTI-CORE CABLE

The present application is based on Japanese patent application No. 2012-180897 filed on Aug. 17, 2012, the entire contents of which are incorporated herein by reference.

BACKGROUND OF THE INVENTION

1. Field of the Invention

The present invention relates to a differential signal transmission cable having a structure in which a shield tape is longitudinally wrapped, and a multi-core cable.

2. Description of the Related Art

Hitherto, a differential signal transmission cable is known in which an insulator is provided around a pair of center conductors to transmit a differential signal, and a shield tape including an insulator layer having one surface provided with a conductor layer is wrapped around the insulator.

In the differential signal transmission cable as stated above, when the shield tape is spirally wrapped around the insulator, the insulator layer and the conductor layer are periodically arranged along the longitudinal direction of the cable. Thus, there is a problem that a resonant phenomenon (suck out) occurs due to the wrapping pitch of the shield tape, and a usable frequency band is limited. In order to avoid such a problem, a differential signal transmission cable is proposed in which a shield tape is longitudinally wrapped around an insulator such that both ends of the shield tape overlap each other along the longitudinal direction of the cable.

In the differential signal transmission cable including the shield tape longitudinally wrapped, a unit configured to closely wrap the shield tape around the insulator and to prevent loosening of the shield tape is required.

U.S. Pat. No. 7,790,981 (Patent Literature 1) discloses a differential signal transmission cable having a structure in which an insulating tape for pressing is laterally wrapped (spirally wrapped) around a shield tape. In Patent Literature 1, a first insulating tape is spirally wrapped around the shield tape so that an adhesive surface faces outside, and further, a second insulating tape is spirally wrapped around the outside thereof so that an adhesive surface faces inside and wrapping directions of both the insulating tapes are opposite to each other. The adhesive surfaces of the two insulating tapes are adhered to each other and fixed, and the loosening of the shield tape is prevented.

U.S. Pat. No. 6,677,518 (Patent Literature 2) discloses a differential signal transmission cable in which an insulating material is covered, as a sheath, on the outside of a shield tape.

SUMMARY OF THE INVENTION

In a differential signal transmission cable having no drain wire for grounding a conductor layer of a shield tape, in order to ground the conductor layer of the shield tape, a termination process of exposing the conductor layer of the shield tape at a terminal is required to be performed.

In Patent Literature 2, since the insulating material is covered, as the sheath, on the outside of the shield tape, it is difficult to expose the conductor layer of the shield tape at the terminal.

On the other hand, in Patent Literature 1, since the shield tape and the insulating tape are not directly adhered to each other, the conductor layer of the shield tape can be easily exposed.

However, in Patent Literature 1, since the insulating tape is not fixed unless the second insulating tape is wrapped after the first insulating tape is wrapped, the insulating tape is liable to be loosened at the time of manufacture. As a result, there is a disadvantage that the shield tape is loosened and the transmission characteristic is deteriorated. In order to prevent the loosening of the insulating tape at the time of manufacture as stated above, the two insulating tapes are required to be wrapped in one step, and the manufacturing process becomes complicated and the manufacturing cost becomes high.

The invention is made under the above circumstances, and has an object to provide a differential signal transmission cable and a multi-core cable the manufacture of which is easy, whose deterioration in a transmission characteristic can be prevented by preventing loosening of a shield tape, and whose shield tape can be easily exposed at a terminal.

(1) According to one exemplary aspect of the invention, a differential signal transmission cable includes a pair of center conductors for transmitting a differential signal, an insulator covering peripheries of the center conductors, a shield tape longitudinally wrapped around the insulator, an insulating tape including an adhesive surface and spirally wrapped around the shield tape while the adhesive surface faces inside, and a non-adhesive tape provided between the shield tape and the insulating tape along a longitudinal direction, and non-adhesively covering a part of an outer periphery of the shield tape in a circumferential direction.

In the above exemplary invention (1), many exemplary modifications and changes can be made as below.

(i) The shield tape includes an overlap part where ends of the shield tape in a width direction overlap each other, and the non-adhesive tape is arranged at a position opposite to the overlap part.

(ii) The insulator collectively covers the pair of center conductors, and the non-adhesive tape has a width narrower than a width of the insulator in an arrangement direction of the center conductors.

(iii) The shield tape includes an insulator layer and a conductor layer provided on one surface of the insulating layer, and is longitudinally wrapped around the insulator while the conductor layer faces outside.

(iv) The shield tape includes only a conductor layer.

(2) According to another exemplary aspect of the invention, a multi-core cable includes plural twisted differential signal transmission cables, and a protective jacket provided around the cables, wherein at least one of the differential signal transmission cables includes a pair of center conductors for transmitting a differential signal, an insulator covering peripheries of the center conductors, a shield tape longitudinally wrapped around the insulator, an insulating tape including an adhesive surface and spirally wrapped around the shield tape while the adhesive surface faces inside, and a non-adhesive tape provided between the shield tape and the insulating tape along a longitudinal direction, and non-adhesively covering a part of an outer periphery of the shield tape in a circumferential direction.

The above exemplary modifications may be made alone or in any combination thereof.

According to the exemplary aspects of the invention, the differential signal transmission cable and the multi-core cable the manufacture of which is easy, whose deterioration in the transmission characteristic can be prevented by preventing the loosening of the shield tape, and whose shield tape can be easily exposed at the terminal can be provided.

DETAILED DESCRIPTION OF THE PREFERRED EMBODIMENTS

Hereinafter, embodiments of the invention will be described with reference to the attached drawings.

Figure 1A:
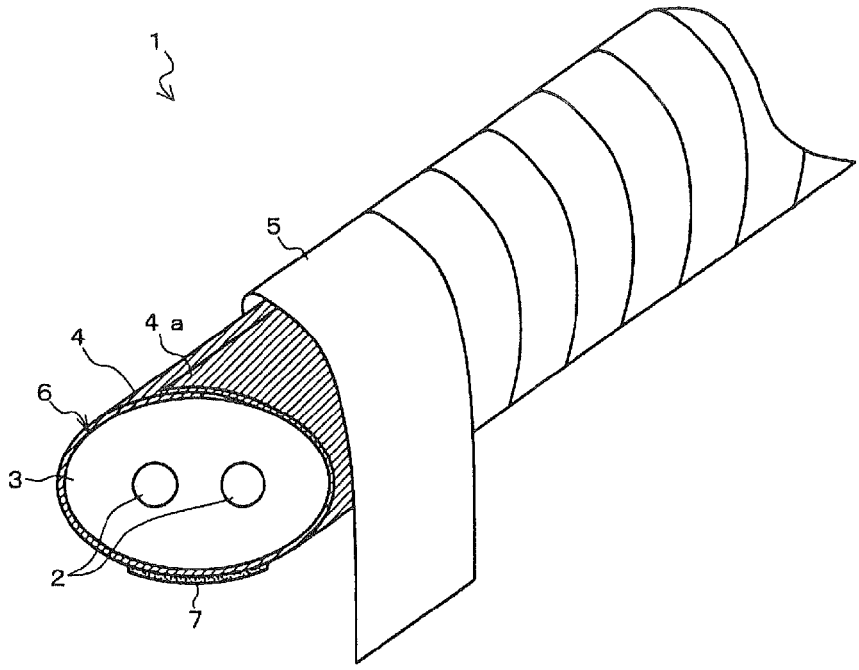
FIGS. 1A and 1B are perspective views of a differential signal transmission cable of an embodiment of the invention.
Figure 1B:
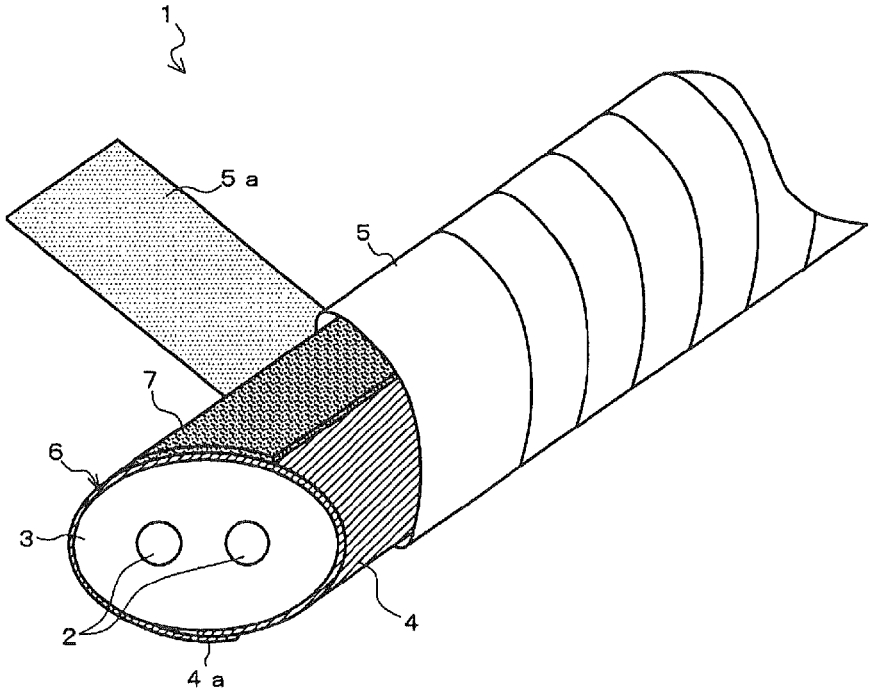
Figure 2:
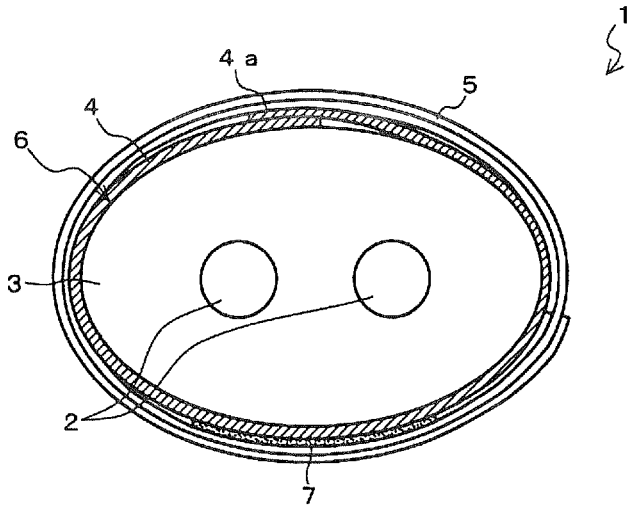
FIG. 2 is a cross-sectional view of the differential signal transmission cable of FIGS. 1A and 1B.

FIGS. 1A and 1B are perspective views of a differential signal transmission cable of an embodiment, and FIG. 2 is a cross-sectional view thereof.

As shown in FIGS. 1A and 1B and FIG. 2, a differential signal transmission cable 1 includes a pair of center conductors 2 to transmit a differential signal, an insulator 3 covering peripheries of the center conductors 2, a shield tape 4 longitudinally wrapped around the insulator 3, and an insulating tape 5 spirally wrapped while an adhesive surface 5*a* faces inside.

In this embodiment, a twin-ax core 6 is formed by providing the insulator 3 so as to collectively cover the pair of center conductors 2 arranged in parallel to each other, and the shield tape 4 is provided to be longitudinally wrapped around the twin-ax core 6. Incidentally, no limitation is made to this, and for example, the core may be such that two insulating electric wires each including the center conductor 2 covered with the insulator 3 are arranged in parallel or to be twisted.

In this embodiment, the insulator 3 is formed into an elliptical shape in a cross-sectional view, and the shield tape 4 is longitudinally wrapped so that an overlap part 4*a* where ends of the shield tape 4 in the width direction overlap each other is positioned in the vicinity of one of tops in the short axis direction thereof.

Besides, in this embodiment, the shield tape 4 including an insulator layer made of PET (polyethylene terephthalate) or the like and a conductor layer provided on one surface of the insulator layer is used, and the shield tape 4 is longitudinally wrapped around the insulator 3 while the conductor layer faces outside. However, no limitation is made to this, and the shield tape 4 including only a conductor layer (that is, a metal foil) may be used. If the shield tape 4 including only the conductor layer is used, the dielectric constant of the insulator layer does not influence an inside electromagnetic field, and the transmission characteristic can be made more excellent.

As the conductor layer of the shield tape 4, copper is preferably used. In general, lightweight aluminum is often used for the conductor layer of the shield tape 4. However, the differential signal transmission cable 1 of this embodiment does not include a drain wire, and an electric wire for grounding, a terminal (after-mentioned termination process terminal) or the like is required to be connected to the conductor layer of the shield tape 4. In order to facilitate soldering to the conductor layer at this time, copper is preferably used for the conductor layer. Further, as the copper used for the conductor layer, a rolled copper foil having high strength against extension and bending or an electrolytic copper foil is preferably used.

The differential signal transmission cable 1 of the embodiment includes a non-adhesive tape 7 provided between the shield tape 4 and the insulating tape 5 along a longitudinal direction so as to cover a part of the outer periphery of the shield tape 4 in a circumferential direction. The non-adhesive tape 7 is non-adhesively provided on the shield tape 4.

Preferably, the non-adhesive tape 7 having non-adhesiveness is used. However, if a peeling property from the shield tape 4 is sufficiently secured, a tape having some adhesiveness may be used. As the non-adhesive tape 7, for example, a fluorine resin tape, a Teflon tape, a Teflon containing glass cross tape, a fluorine resin containing glass cross tape or the like can be used (Teflon is a registered trademark).

At the position where the non-adhesive tape 7 is provided, the insulating tape 5 is not adhered to the shield tape 4. Incidentally, if the non-adhesive tape 7 is provided on the overlap part 4*a* of the shield tape 4, the ends of the shield tape 4 in the width direction are neither adhered nor fixed, and the shield tape 4 becomes liable to be loosened. Thus, the non-adhesive tape 7 is preferably provided at a position other than the overlap part 4*a* of the shield tape 4. In view of easiness of installation of the after-mentioned termination process terminal and easiness of working, the non-adhesive tape 7 is preferably provided at a position opposite to the overlap part 4*a*, that is, in the vicinity of the other top, in the short axis direction, of the insulator 3 having the elliptical shape in a cross-sectional view.

If the width of the non-adhesive tape 7 is made excessively wide, the adhesion area between the insulating tape 5 and the shield tape 4 is reduced, and the force of holding the shield tape 4 becomes weak. Thus, the non-adhesive tape 7 is preferably formed to have a width narrower than the width of the insulator 3 in the arrangement direction of the center conductors 2.

Figure 3A:
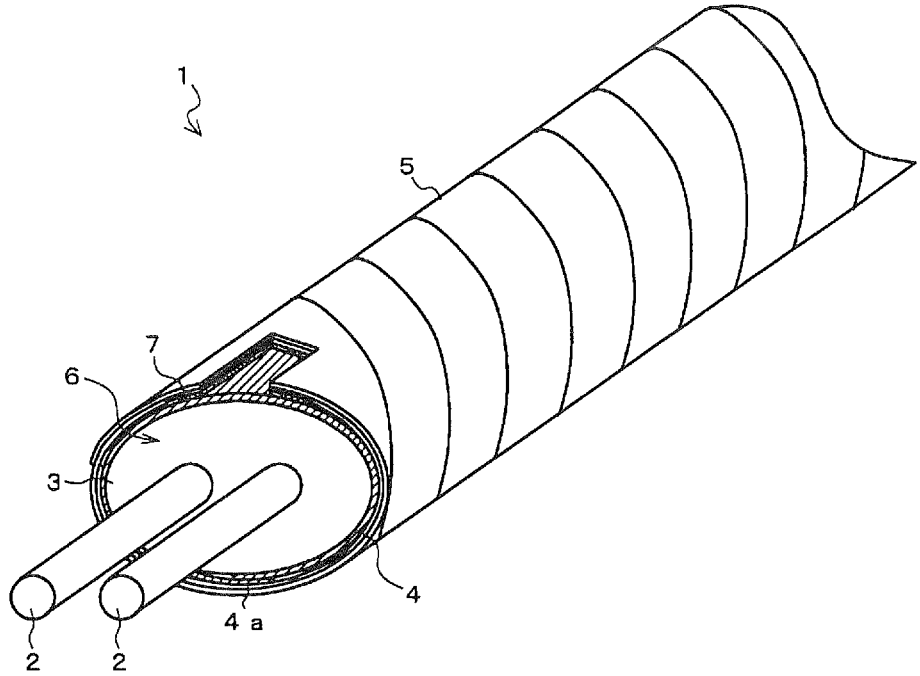
FIG. 3A is a perspective view in which a shield tape is exposed at a terminal of the differential signal transmission cable of FIGS. 1A and 1B.

When the termination process of the differential signal transmission cable 1 is performed, as shown in FIG. 3A, the insulating tape 5, together with the non-adhesive tape 7, is peeled at the position where the non-adhesive tape 7 is formed. At this time, since the non-adhesive tape 7 is not adhered to the shield tape 4, the tape can be easily peeled.

The insulating tape 5 and the non-adhesive tape 7 can be cut by a laser such as a $CO_2$ laser. Besides, copper used for the conductor layer of the shield tape 4 is hard to be cut by the laser as compared with the insulating tape 5 and the non-adhesive tape 7. Thus, the conductor layer of the shield tape 4 is exposed (opened) by cutting off the insulating tape 5 and the non-adhesive tape 7 at the desired position by the laser.

Figure 3B:
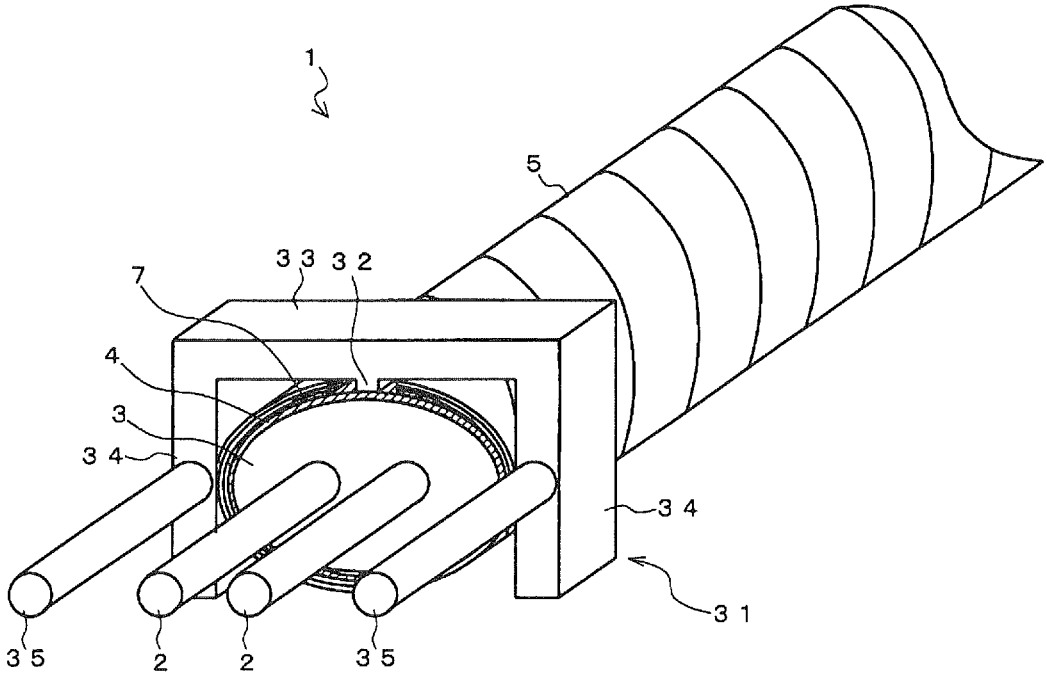
FIG. 3B is a perspective view in which a termination process terminal is provided.

For example, a termination process terminal 31 as shown in FIG. 3B is soldered to the surface of the exposed conductor layer, and the conductor layer of the shield tape 4 can be electrically connected to an external medium (e.g. a printed board) through the termination process terminal 31.

In this embodiment, the termination process terminal 31 includes a horizontal part 33 provided with a projection 32 to be soldered to the surface of the conductor layer of the shield tape 4, vertical parts 34 respectively extending downward (differential signal transmission cable 1 side) from both ends of the horizontal part 33, and cylindrical terminal parts 35 respectively extending forward (connection direction, extending direction of the center conductors 2) from both the vertical parts 34 and to be connected to the external medium. However, the shape of the termination process terminal 31 is not limited to this.

When the plural differential signal transmission cables 1 of the invention are twisted, and a protecting jacket is provided around them, a multi-core cable of the invention is obtained. Incidentally, the differential signal transmission cable 1 of the invention is not required to be used as each of the differential signal transmission cables included in the multi-core cable, and the differential signal transmission cable 1 of the invention has only to be used as at least one of the differential signal transmission cables included in the multi-core cable.

The operation of the embodiment will be described.

The differential signal transmission cable 1 of the embodiment includes the non-adhesive tape 7 that is provided between the shield tape 4 and the insulating tape 5 along the longitudinal direction so as to cover a part of the outer periphery of the shield tape 4 in the circumferential direction, and is non-adhesively provided on the shield tape 4.

Since the shield tape 4 at the portion covered with the non-adhesive tape 7 is not adhered to the insulating tape 5, the non-adhesive tape 7 and the insulating tape 5 at this portion can be locally removed, and the conductor layer of the shield tape 4 can be easily exposed at the terminal.

Besides, in the differential signal transmission cable 1, the shield tape 4 and the insulating tape 5 are directly adhered and fixed at a portion other than the portion covered with the non-adhesive tape 7. Thus, it does not occur that the insulating tape 5 is loosened and the adhesiveness between the shield tape 4 and the insulator 3 is impaired. Accordingly, the loosening of the shield tape 4 is prevented and the deterioration in the transmission characteristic can be prevented.

In Patent Literature 1 in which the shield tape and the insulating tape are not directly adhered to each other, for example, after the conductor layer of the shield tape is connected to an external equipment, when a force is exerted in a direction in which the cable is pulled, stress is concentrated only on the shield tape, and there is a fear that the shield tape is ruptured. However, in the differential signal transmission cable 1 of the embodiment, since the shield tape 4 and the insulating tape 5 are directly adhered and fixed, the insulating tape 5 serves to reinforce the shield tape 4, and the rupture of the shield tape 4 can be suppressed.

Further, in the differential signal transmission cable 1, unlike the related art, a complicated step of wrapping two insulating tapes in one step is not required, and the manufacture is easy and the manufacture cost can be reduced.

Further, in the differential signal transmission cable 1, since the non-adhesive tape 7 is arranged at the position opposite to the overlap part 4*a* of the shield tape 4, when the non-adhesive tape 7 and the insulating tape 5 are peeled off, the overlap part 4*a* of the shield tape 4 is not opened, and the deterioration in the characteristic due to the termination process can be suppressed.

The invention is not limited to the above embodiment and can be variously modified within the scope not departing from the spirit of the invention.

What is claimed is:

1. A differential signal transmission cable, comprising: a pair of center conductors for transmitting a differential signal; an insulator covering peripheries of the center conductors; a shield tape longitudinally wrapped around the insulator such that both ends of the shield tape overlap each other along a longitudinal direction of the cable and the shield tape comprises an overlap part where the both ends of the shield tape in a width direction overlap each other; an insulating tape comprising an adhesive surface and spirally wrapped around the shield tape while the adhesive surface faces inside; and a non-adhesive tape provided between the shield tape and the insulating tape along the longitudinal direction, and non-adhesively covering a part of an outer periphery of the shield tape in a circumferential direction wherein the shield tape and the insulating tape are directly adhered at a portion other than a portion covered with the non-adhesive tape, and wherein the non-adhesive tape is arranged at a position opposite to the overlap part with respect to the insulator.

2. The differential signal transmission cable according to claim 1, wherein the insulator collectively covers the pair of center conductors, and wherein the non-adhesive tape has a width narrower than a width of the insulator in an arrangement direction of the center conductors.

3. The differential signal transmission cable according to claim 1, wherein the shield tape comprises an insulator layer and a conductor layer provided on one surface of the insulating layer, and is longitudinally wrapped around the insulator while the conductor layer faces outside.

4. The differential signal transmission cable according to claim 1, wherein the shield tape comprises only a conductor layer.

5. A multi-core cable, comprising: a plurality of twisted differential signal transmission cables; and a protective jacket provided around the cables, wherein at least one of the differential signal transmission cables comprises: a pair of center conductors for transmitting a differential signal, an insulator covering peripheries of the center conductors; a shield tape longitudinally wrapped around the insulator such that both ends of the shield tape overlap each other along a longitudinal direction of the cable; an insulating tape including an adhesive surface and spirally wrapped around the shield tape while the adhesive surface faces inside; and a non-adhesive tape provided between the shield tape and the insulating tape along the longitudinal direction, and non-adhesively covering a part of an outer periphery of the shield tape in a circumferential direction, and wherein the shield tape and the insulating tape are directly adhered at a portion other than a portion covered with the non-adhesive tape, and wherein the non-adhesive tape and an area where the both ends of the shield tape overlap each other face each other and are located in opposing sides of the pair of center conductors.

6. The differential signal transmission cable according to claim 1, wherein the differential signal transmission cable is devoid of a drain wire.

7. The differential signal transmission cable according to claim 1, wherein the non-adhesive tape faces an area where the both ends of the shield tape overlap each other.

8. The differential signal transmission cable according to claim 1, wherein the shield tape comprises an overlap part where the both ends of the shield tape overlap each other, and wherein the non-adhesive tape is arranged at a position opposite to the overlap part with respect to the pair of center conductors.

9. The differential signal transmission cable according to claim 1, wherein the shield tape comprises an overlap part where the both ends of the shield tape overlap each other, and wherein the non-adhesive tape and the overlap part face each other and are located in opposing sides of the pair of center conductors.

10. The differential signal transmission cable according to claim 1, wherein the non-adhesive tape is disposed on a surface of the shield tape.

11. The differential signal transmission cable according to claim 1, wherein the non-adhesive tape abuts the shield tape and the insulating tape.

12. The multi-core cable 5, wherein the shield tape comprises an overlap part where the both ends of the shield tape in a width direction overlap each other, and wherein the non-adhesive tape is arranged at a position opposite to the overlap part with respect to the insulator.

13. The multi-core cable 5, wherein the non-adhesive tape and an area where the both ends of the shield tape overlap each other face each other and are located in opposing sides of the pair of center conductors.

14. The multi-core cable 5, wherein the non-adhesive tape faces an area where the both ends of the shield tape overlap each other.

15. The multi-core cable 5, wherein the shield tape comprises an overlap part where the both ends of the shield tape overlap each other, and wherein the non-adhesive tape is arranged at a position opposite to the overlap part with respect to the pair of center conductors.

16. The multi-core cable 5, wherein the shield tape comprises an overlap part where the both ends of the shield tape overlap each other, and wherein the non-adhesive tape and the overlap part face each other and are located in opposing sides of the pair of center conductors.

17. The multi-core cable 5, wherein the non-adhesive tape is disposed on a surface of the shield tape.

18. The multi-core cable 5, wherein the non-adhesive tape abuts the shield tape and the insulating tape.

* * * * *